United States Patent [19]

Trotta

[11] 4,094,063

[45] June 13, 1978

[54] RAZOR ASSEMBLY WITH PIVOTALLY MOUNTED CARTRIDGE

[75] Inventor: Robert Anthony Trotta, Winthrop, Mass.

[73] Assignee: The Gillette Company, Boston, Mass.

[21] Appl. No.: 750,958

[22] Filed: Dec. 15, 1976

[51] Int. Cl.[2] ..... B26B 21/06; B26B 21/22

[52] U.S. Cl. ..... 30/47; 30/87

[58] Field of Search ..... 30/47, 50, 57, 74.1, 30/85, 87, 89

[56] References Cited

U.S. PATENT DOCUMENTS

| | | | |
|---|---|---|---|
| 3,593,416 | 7/1971 | Edson | 30/50 |
| 3,740,841 | 6/1973 | Risher | 30/57 X |
| 3,935,639 | 2/1976 | Terry | 30/50 X |
| 3,938,247 | 2/1976 | Carbonell | 30/50 X |
| 3,950,849 | 4/1976 | Perry | 30/57 X |
| 3,975,820 | 8/1976 | Torance | 30/47 |
| 4,026,016 | 5/1977 | Nissen | 30/47 |

FOREIGN PATENT DOCUMENTS

| | | | |
|---|---|---|---|
| 2,409,602 | 9/1974 | Germany | 30/47 |

*Primary Examiner*—Gary L. Smith

*Attorney, Agent, or Firm*—Richard A. Wise; Oistein J. Bratlie; Scott R. Foster

[57] ABSTRACT

A razor assembly including a handle and a shaving unit of the type in which a blade and guard are permanently fixed together, the handle including means at one end thereof for pivotally mounting the shaving unit on the handle such that the shaving unit is free to pivot upon the handle during a shaving operation, the handle being a one-piece plastic molding and having means thereon for biasing the pivotally movable shaving unit toward a central position.

2 Claims, 5 Drawing Figures

RAZOR ASSEMBLY WITH PIVOTALLY MOUNTED CARTRIDGE

BACKGROUND OF THE INVENTION

1. Field of the Invention

The invention relates to wet shaving implements and is directed more particularly to a razor assembly including a handle and a shaving unit of the type having a blade and guard permanently fixed together.

2. Description of the Prior Art

It is known to mount on a razor handle of the type shown in U.S. Pat. No. 3,768,162 shaving units of the type disclosed and described in U.S. Pat. Nos. 3,703,764; 3,724,070 and 3,832,774.

A modification of the shaving unit and handle system shown in the above-mentioned patents appears in U.S. Pat. No. 4,026,016, issued May 31, 1977, in the name of Warren I. Nissen; and Ser. No. 576,254, filed May 12, 1975 in the names of Warren I. Nissen et al, which show, respectively, a shaving unit and handle in which the shaving unit is pivotally mounted on one end of the handle. A used shaving unit may be released from the handle and a new shaving unit connected thereto.

U.S. Pat application Ser. No. 576,252, filed May 12, 1975, in the name of Robert A. Trotta, now abandoned shows a disposable razor assembly including a one-piece molded handle and a pivotally mounted shaving unit thereon, it being intended that the whole assembly be disposed of upon dulling of the cutting edge of the blade means.

SUMMARY OF THE INVENTION

An object of the present invention is to provide an improved disposable razor assembly including a one-piece molded handle and a shaving unit pivotally mounted and permanently attached to the handle.

A further object of the invention is to provide such a razor assembly in which the shaving unit portion is acted upon by a handle based biasing force which urges the movable shaving unit to a central position.

With the above and other objects in view, as will hereinafter appear, a feature of the present invention is the provision of a razor assembly including a shaving unit and handle, the shaving unit having platform means and blade means, first pivotal means for pivotally mounting the shaving unit on the handle, and cam means for receiving a biasing force from the handle, the handle including a head portion having arm means with second pivotal mounting means complemental to the first pivotal mounting means, and a resilient member anchored at either end thereof to the head portion, the resilient member being in engagement with the shaving unit cam means for exerting said biasing force on the cam means.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 2:
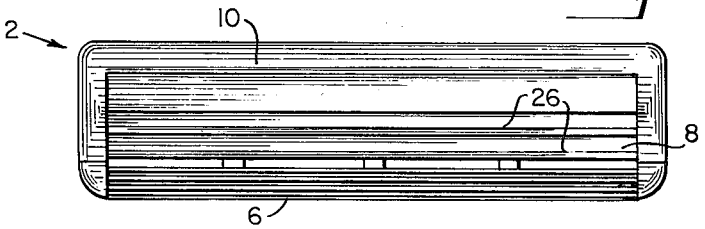
FIG. 2 is a top plan view of the shaving unit portion of the razor assembly.
Figure 3:
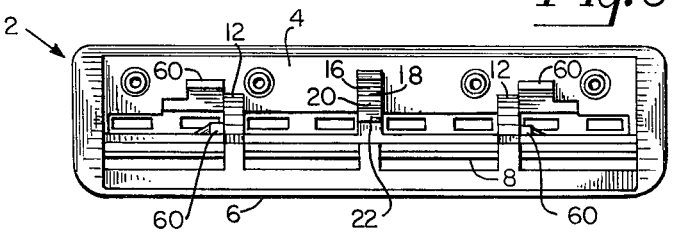
FIG. 3 is a bottom view thereof.
Figure 5:
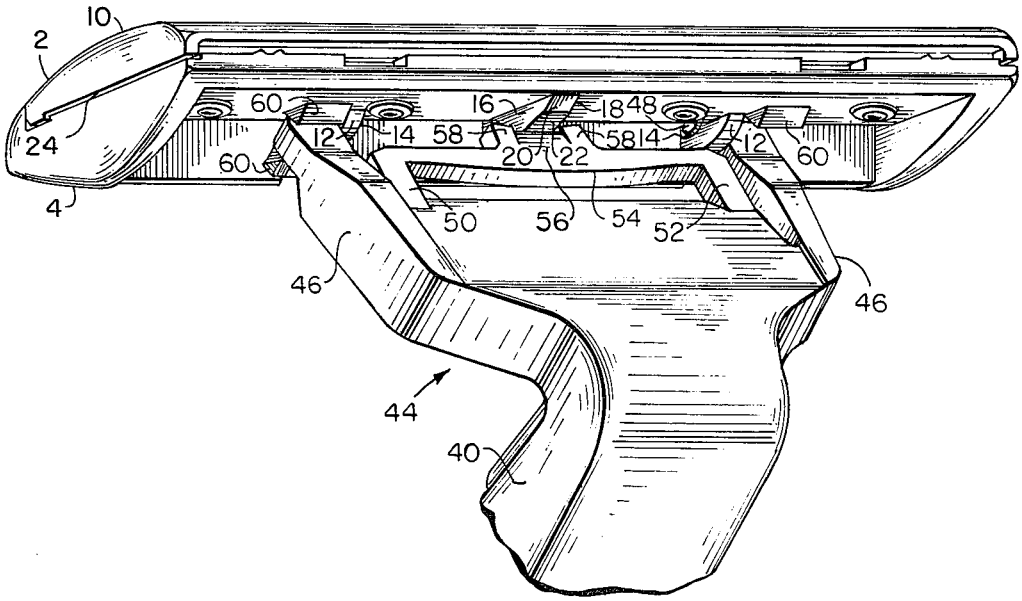
FIG. 5 is a perspective view similar to FIG. 4 but showing the handle with the shaving unit mounted thereon.

Referring to FIGS. 2, 3 and 5, it will be seen that the illustrative razor assembly includes a shaving unit 2 of the type fully disclosed and described in U.S. Pat. No. 4,026,016, issued May 31, 1977, referred to above. The shaving unit includes a platform member 4 having a guard means 6 and on which is disposed a blade means 8 and thereon a cap member 10. The cap and platform members are fixed together with the blade means disposed therebetween. The shaving unit is provided with projections 12 defining journal bearings 14 (FIG. 5) and a projection 16 defining cam means 18 having cam surfaces 20, 22. The blade means 8 may comprise more than one blade, if desired, and if so, may also include spacer means 24 (FIG. 5) separating blades 26 (FIG. 2). The journal bearings 14 constitute a pivotal mounting means by which the shaving unit is pivotally mounted on the handle.

Figure 1:
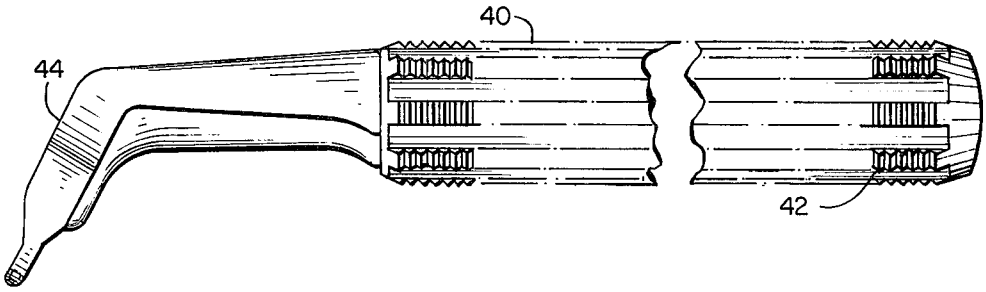
FIG. 1 is a side elevational view of one form of razor assembly illustrative of an embodiment of the invention.
Figure 4:
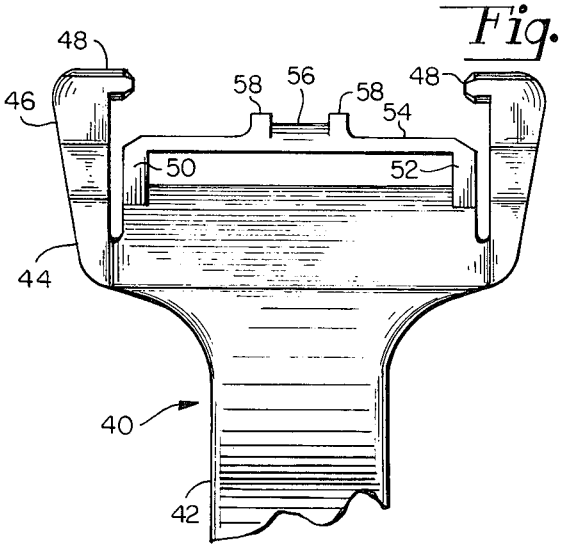
FIG. 4 is an elevational view of the head portion of the razor handle.

Referring to FIGS. 1 and 4, it will be seen that the handle 40 includes a grip portion 42 and a head portion 44. The head portion 44 is provided with arms 46 provided with journals 48 which constitute a second pivotal mounting means complemented to the journal bearings 14. The head portion 44 further includes first and second supports 50, 52 interconnected by a resilient bridge means 54 which constitutes a leaf spring anchored at either end thereof. The mid-portion of the bridge means 54 is provided with cam follower means 56 and stop means 58 on either side of the cam follower means 56.

The arms 46 are preferably molded integrally with the handle 40 and are sufficiently narrow at their juncture with the head portion 44 to permit a slight flexing outwardly in manufacture in order to receive the shaving unit therebetween. The plastic material of the razor handle, and therefore the arms 46, is on the other hand, sufficiently rigid so that the arms 46 are not likely to be opened by an operator or by an accidental fall so as to release the shaving unit held therebetween.

Referring to FIG. 5, it will be seen that in use, the shaving unit 2 is free to pivot upon the journals 48. The cam means 18 is engaged by the cam follower means 56 and bounded by the stop means 58. During a shaving operation, pivoting movement of the shaving unit causes commensurate movement of the cam means 18, causing either cam surface 20 or 22 to bear against the cam follower means 56, forcing the bridge portion 54 to flex (FIG. 5). The resilient nature of the bridge portion 54, however, exercises a bias against the cam surfaces 20, 22 to return the cam means, and thereby the shaving unit, to a central position in which the cam follower means 56 is disposed at the juncture of the cam surfaces 20, 22. The shaving unit may be provided with stop means 60 for positively limiting the pivotal movement permitted the shaving unit.

It is to be understood that the present invention is by no means limited to the particular construction herein disclosed and/or shown in the drawings, but also comprises any modifications or equivalents within the scope of the disclosure.

Having thus described my invention what I claim as new and desire to secure the Letters Patent of the United States is:

1. Razor assembly comprising a shaving unit and a handle, said shaving unit having platform means, blade means, first pivotal mounting means for pivotally connecting said shaving unit to said handle, and cam means for receivng a biasing force from said handle, said handle including a head portion having arm means with second pivotal mounting means complemental to said first pivotal mounting means and a resilient member anchored at either end thereof to said head portion, said resilient member comprising first and second legs upstanding from said head portion and a bridge portion extending between the first and second legs and otherwise removed from said head portion, said resilient member bridge portion being in engagement with said shaving unit cam means for exerting said biasing force thereon, said handle comprising a single molded plastic unit.

2. Razor assembly comprising a shaving unit portion and a handle portion, said shaving unit portion comprising platform means including a guard portion, blade means, and cap means, permanently fixed together with said blade means disposed between said cap means and said platform means, said shaving unit portion further comprising first pivotal mounting means for pivotally connecting said shaving unit to said handle, and cam means for receiving a biasing force from said handle, said handle portion comprising a single plastic unit including an elongated grip portion and a head portion, said head portion comprising first and second arms having second pivotal mounting means thereon complemental to said first pivotal mounting means, and a bridge portion comprising first and second supports upstanding from said head portion, resilient bridge means extending between said first and second supports and otherwise removed from said head portion, and cam follower means on said bridge means for engagement with said shaving unit cam means for exerting said biasing force on said cam means.

* * * * *